United States Patent [19]

Yargus et al.

[11] 4,350,444

[45] Sep. 21, 1982

[54] APPARATUS FOR MIXING MATERIALS SUCH AS FERTILIZER COMPONENTS

[75] Inventors: Lloyd A. Yargus, R.R. #2, Marshall, Ill. 62441; Lester W. Switzer, Sr., Marshall, Ill.; Gary N. Allen, Martinsville, Ill.; Gary S. Elliott, Cropsey, Ill.; Larry D. Yargus, 402 N. 7th St., Marshall, Ill. 62441; William D. Lowry, Martinsville, Ill.; Jeffrey M. Gosnell, Marshall, Ill.; Darrell J. Spires, Marshall, Ill.

[73] Assignees: Lloyd A. Yargus; Larry D. Yargus, both of Marshall, Ill.

[21] Appl. No.: 205,919

[22] Filed: Nov. 12, 1980

[51] Int. Cl.[3] ..... B01F 7/24

[52] U.S. Cl. ..... 366/141; 366/150; 366/193; 366/266

[58] Field of Search ..... 366/603, 186, 193, 194, 366/195, 196, 266, 141, 183, 150

[56] References Cited

U.S. PATENT DOCUMENTS

| | | | |
|---|---|---|---|
| 1,720,360 | 7/1929 | Haines | 366/603 |
| 3,065,808 | 11/1962 | Dodgen | 366/266 |
| 3,251,484 | 5/1966 | Hagan | 366/141 |
| 3,259,375 | 7/1966 | Sackett | 366/141 |
| 3,395,898 | 8/1968 | Westelaken | 366/141 |
| 3,563,399 | 2/1971 | Shivers | 366/266 |

*Primary Examiner*—Robert W. Jenkins

*Attorney, Agent, or Firm*—Allegretti, Newitt, Witcoff & McAndrews

[57] ABSTRACT

An apparatus for mixing materials is disclosed. The apparatus includes a hopper, a substantially vertical auger within the hopper, and a housing enclosing the auger to define a mixing chamber. A baffle, attached to the housing, and the sidewall of the hopper are oriented so as to cooperatively provide a blending flow pattern within the hopper, thereby further mixing the materials.

9 Claims, 3 Drawing Figures

APPARATUS FOR MIXING MATERIALS SUCH AS FERTILIZER COMPONENTS

BACKGROUND OF THE INVENTION

The present invention relates generally to mixing devices and more particularly to an apparatus for mixing fertilizer and animal feed.

Various mixing devices are presently available and in use for mixing the components of fertilizer and animal feed to provide a substantially homogeneous mixture or blend. One such device is fully described in U.S. Pat. No. 3,090,605.

SUMMARY OF THE INVENTION

In a principal aspect, the present invention is an apparatus for mixing materials, such as the components of a fertilizer. The apparatus includes a hopper for receiving the materials, an auger within the hopper, and a housing substantially enclosing the auger to define a mixing chamber thereabout.

The auger is mounted substantially vertically in a central region of the hopper and draws the materials into the mixing chamber from the bottom of the hopper through a lower opening of the housing. The materials are mixed within the mixing chamber and discharged through an upper opening of the housing.

The sidewall of the hopper converges towards the bottom thereof. A baffle, secured to the housing, extends and diverges towards the bottom of the hopper. In cooperation, the downwardly converging sidewall and downwardly diverging baffle define blender means for developing a blending flow pattern within the hopper as the materials move therethrough. This flow pattern provides further mixing of the materials.

In another aspect, the hopper includes a sump at the bottom thereof. The components to be mixed flow downwardly through the hopper and into the sump under the influence of gravity. The auger, extending into the sump, draws the components therefrom into the mixing chamber. Flowing through the hopper and into the sump, the components pass through the blender means and are thereby supplementally blended.

In yet another aspect, a frame, which supports the hopper in a substantially upright position, includes a scale for weighing the quantity of materials within the hopper. The scale avoids weighing of the materials prior to loading and thereby results in a substantial time savings.

It is thus an object of the present invention to provide an improved apparatus for mixing materials. Another object is a mixing apparatus which provides a substantially homogeneous mixture within a reasonable time after completion of the loading operation.

Still another object of the present invention is to provide an improved mixer wherein a blending flow pattern is created during loading, operation and unloading, such that the materials are supplementally blended or mixed. It is also an object to provide an apparatus for mixing fertilizer and other materials wherein the structure provides a blending action as the materials flow through the apparatus under the influence of gravity.

Yet another object of the present invention is an easily loaded and unloaded mixer. A further object is to provide a safe apparatus for mixing materials wherein the moving and potentially dangerous parts or elements are substantially enclosed to avoid contact therewith.

It is also an object of the present invention to provide a readily manufactured and maintained mixing apparatus. Another object is an energy efficient mixer wherein supplemental blending is provided as the components are gravityfed through the mixer.

These and other objects, features and advantages of the present invention are discussed or apparent in the following detailed description.

BRIEF DESCRIPTION OF THE DRAWING

A preferred embodiment of the present invention is described herein with reference to the drawing wherein.

DETAILED DESCRIPTION OF A PREFERRED EMBODIMENT

Figure 1:
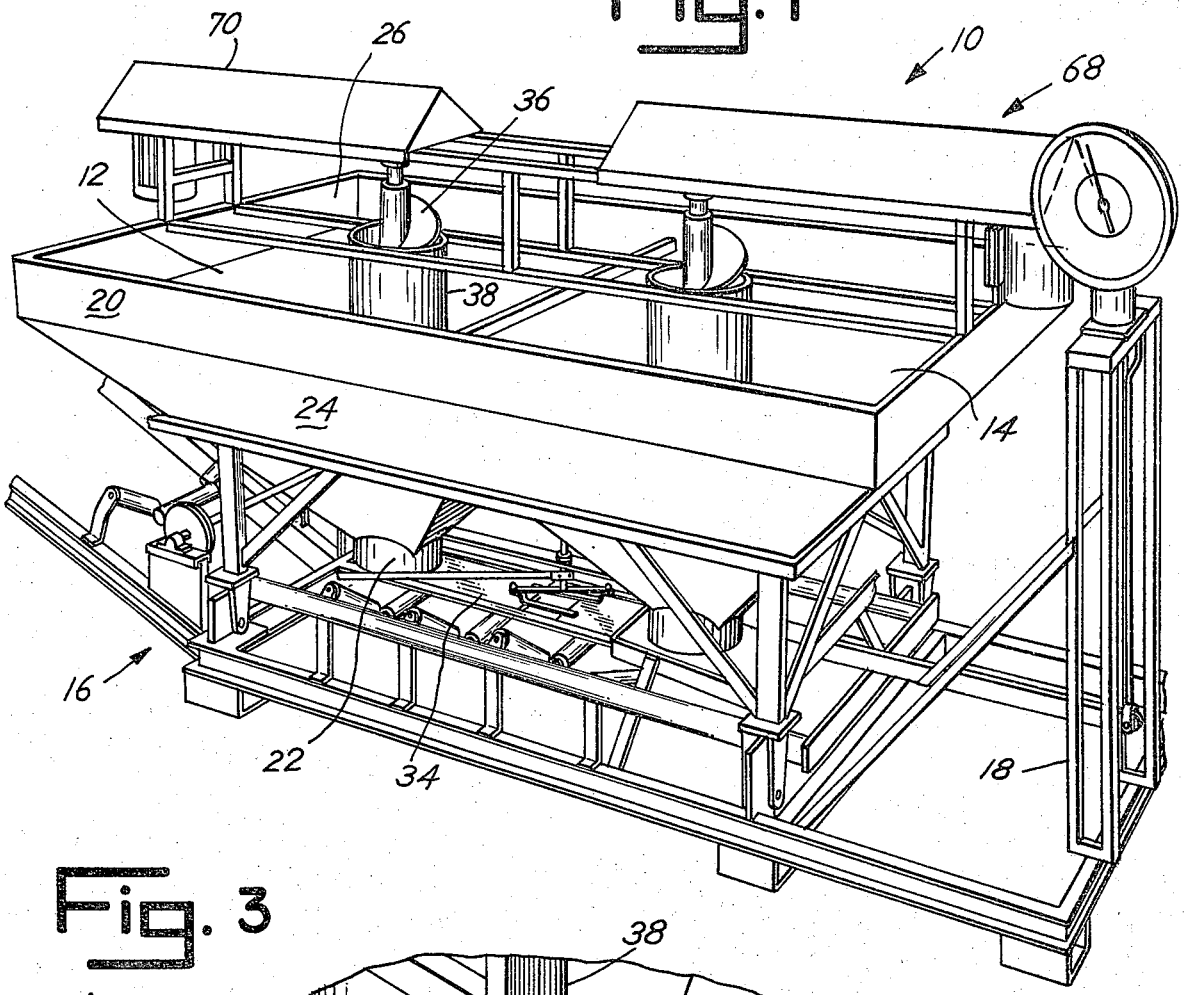
FIG. 1 is a perspective view of a preferred embodiment.
Figure 3:
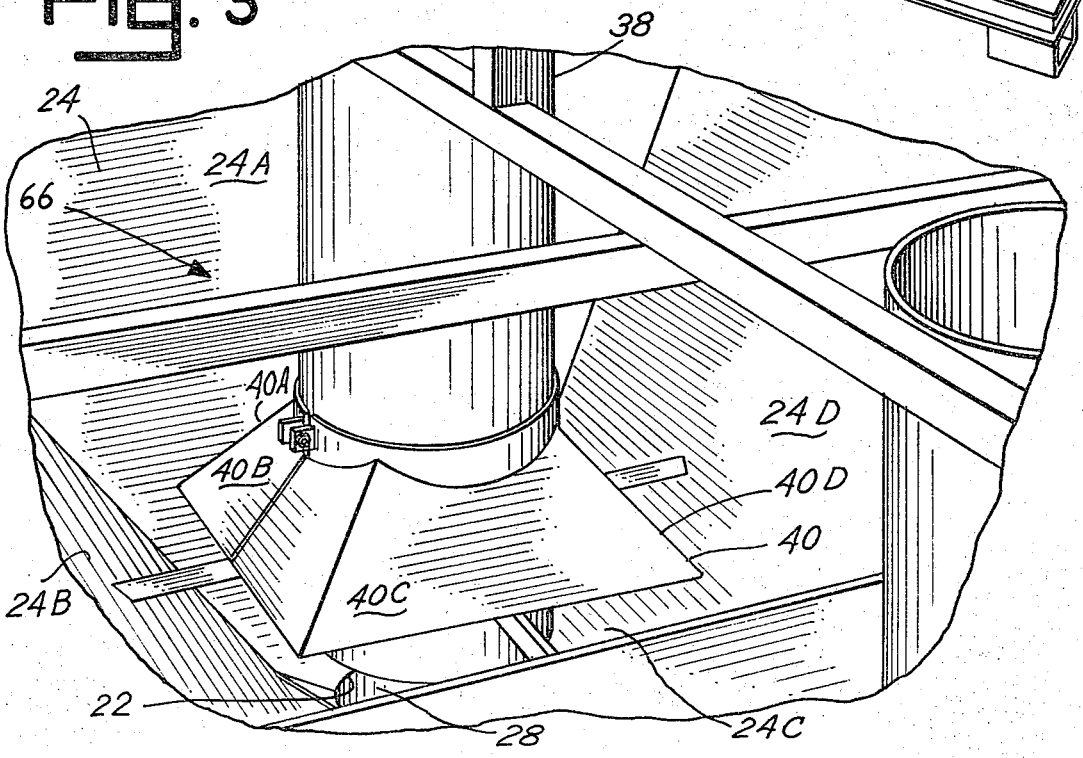
FIG. 3 is a partial perspective view of the housing and baffle shown in FIGS. 1 and 2.
Figure 2:
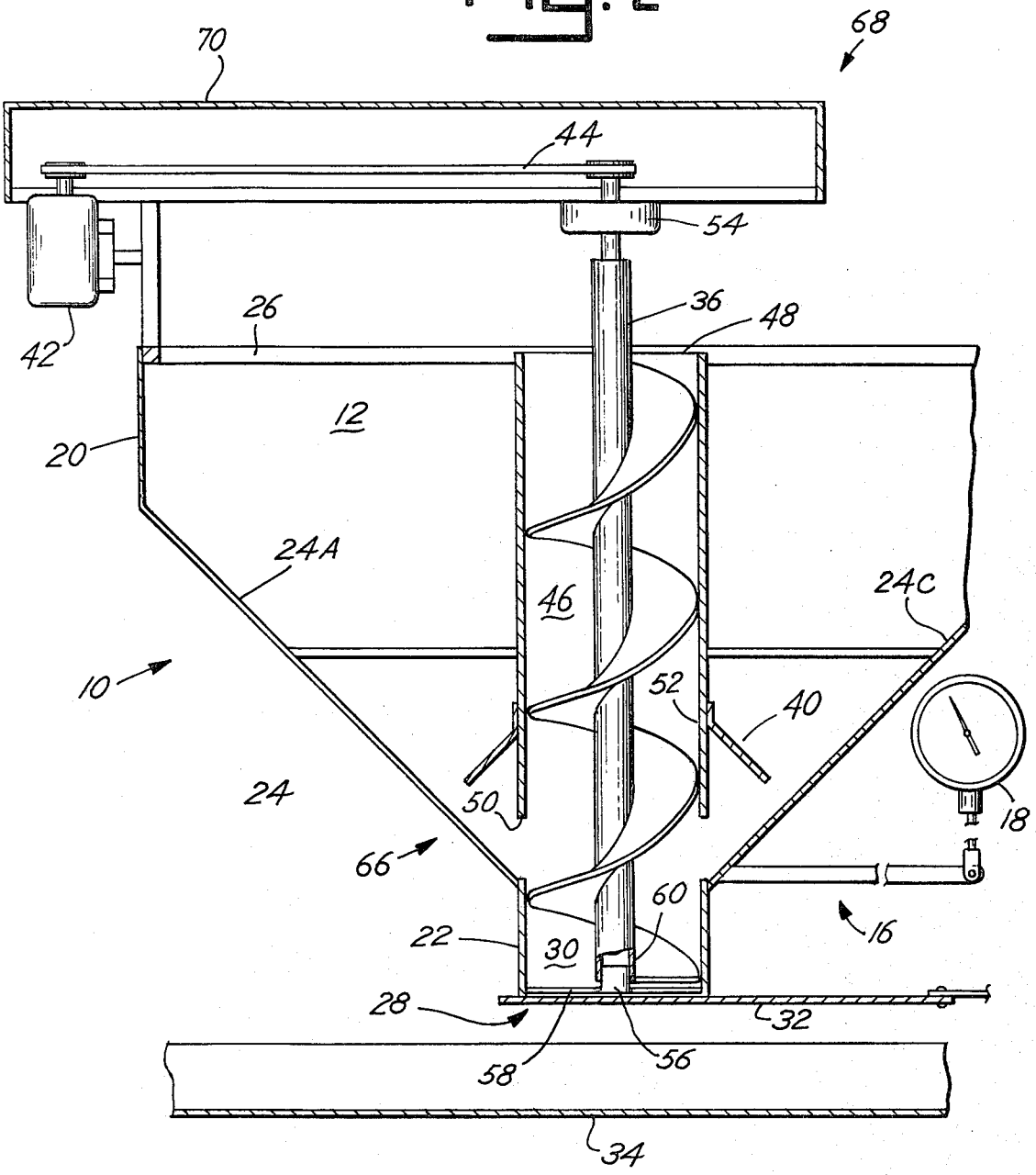
FIG. 2 is a partial cross-sectional view of the embodiment shown in FIG. 1.

Referring to FIGS. 1–3, a preferred embodiment of the present invention is shown as an apparatus 10 for mixing at least two materials, such as the components of a fertilizer. The apparatus 10 includes first and second hoppers 12, 14 of substantially identical structure and configuration. Thus, for purposes of simplification, only hopper 12 will be described in detail. Further, the apparatus 10 requires only a single hopper 12. The configuration shown is merely illustrative, although the pairing of hoppers 12, 14 provides a more readily loadable apparatus 10 and further increases the capacity of the apparatus 10.

The hoppers 12, 14 are secured to and held in a substantially upright position by a frame, generally designated 16. In this preferred embodiment, the frame 16 includes a scale 18, incorporated therein, to weigh the quantity of materials within the hoppers 12, 14. The scale 18 facilitates the mixing operation by permitting the operator to load the apparatus 10 without preweighing the materials. The operator simply notes the increments of each material loaded into the hoppers 12, 14 and adds additional materials, by weight, to provide the desired final composition. This operation permits rapid loading and therefore more efficient operation of the apparatus 10.

The hopper 12 has an upper wall 20, a lower wall 22 and a sidewall 24. As shown, the upper wall 20 defines a substantially square loading port 26. The sidewall 24 includes four substantially planar sidewall portions 24A, 24B, 24C, 24D, converging towards the lower wall 22 of the hopper 12. Preferably, the sidewall portions 24A, 24B, 24C, 24D are inclined at an angle of 30°–45° to the vertical.

The lower wall 22 of the hopper 12 extends downwardly from the sidewall 24 and defines a substantially circular discharge port 28. The lower wall 22 further defines a substantially cylindrical sump 30, and the components or materials to be mixed flow through the hopper 12 and into the sump 30 under the influence of gravity. In this preferred embodiment, the height or depth of the sump 30 is approximately four (4) to six (6) inches.

After mixing to the desired degree, the mixture is discharged from the hopper 12 through the discharge port 28. The apparatus 10 also includes a gate 32 for closing the discharge port 28 during loading and mixing.

In this preferred embodiment, the frame 16 further includes a conveyor 34 extending below the hoppers 12, 14. The conveyor 34 extends substantially below the discharge port 28 for receipt of the mixture therethrough. A portion of the conveyor 34 extends beyond the apparatus 10 and is inclined upwardly to a height permitting discharge of the mixture directly into a truck or other vehicle (not shown).

The apparatus 10 also includes an auger 36, a housing 38 and a baffle 40, as best shown in FIGS. 2 and 3. The auger 36 is drivably mounted within the hopper 12 in a central region thereof. The auger 36 is substantially vertical and extends substantially from the loading port 26 into the sump 30. The auger 36 preferably extends into the sump 30 to a depth of approximately three (3) to five (5) inches.

The auger 36 is driven by an electric motor 42 secured to the frame 16. The auger 36 and the electric motor 42 are interconnected by a flexible drive belt 44.

The housing 38, substantially circular in cross-section, is secured within the hopper 12 and substantially encloses the auger 36 to define a mixing chamber 46 thereabout. The housing 38 extends from a point substantially adjacent the top of the auger 36 to a point substantially adjacent the top of the sump 30. As such, materials flowing into the sump 30 directly engage the portion of the auger 36 therein. The housing 38 has a upper opening 48, a lower opening 50, and a lower portion 52.

As best shown in FIG. 2, the auger 36 is rotatably supported in the hopper 12 by an external upper bearing 54, secured to the frame 16, and an internal lower bearing 56 within the sump 30. The internal lower bearing 56 is secured by a cross member 58 to the lower wall 22 of the hopper 12. A lower shaft portion 60 of the auger 36 is hollow and adapted to receive the internal lower bearing 56. The internal lower bearing 56 facilitates unloading of the hopper 12 by substantially avoiding any blockage within the sump 30.

During operation, the auger 36 rotatingly draws materials from the sump 30 into the mixing chamber 46 through the lower opening 50 of the housing 38. Mixing occurs as the materials travel upwardly through the mixing chamber 46, and the materials are discharged into the hopper 12 through the upper opening 48.

The baffle 40 is attached or secured to the lower portion 52 of the housing 38 so as to provide a restricted passageway 62 between the sidewall 24 and the baffle 40. As best shown in FIG. 3, the baffle 40 defines a central opening 64 to engagingly receive the housing 38 and includes four substantially planar baffle portions 40A, 40B, 40C, 40D, corresponding generally to the sidewall portions 24A, 24B, 24C, 24D, respectively.

The baffle 40 extends downwardly and divergingly towards the lower wall 22 or bottom of the hopper 12. Thus, the baffle portions 40A, 40B, 40C, 40D are oppositely oriented with respect to the sidewall portions 24A, 24B, 24C, 24D respectively. In this preferred embodiment, the baffle portions 40A, 40B, 40C, 40D extend downwardly at an angle of approximately 40°–50° to the vertical. It should also be understood that the configurations of the sidewall 24 and the baffle 40 correspond or match. Both, for example, could be generally conical.

The sidewall 24 of the hopper 12 and the baffle 40 cooperatively define blender means, generally designated 66. The blender means 66 provides a blending flow pattern as the materials pass through the hopper 12 during loading, operation of the auger 36 and unloading. That is, as the materials are gravity-fed through the hopper 12, the blender means 66 causes the materials to flow in an interrupted circulating pattern so as to blend and supplementally mix the materials.

Thus, prior to initially entering the mixing chamber 46, the materials are partially mixed by the blender means 66. The blender means 66 continues to supplement mixing as the materials flow up through the hopper 12 during operation of the auger 36 and unloading of the hopper 12 onto the conveyor 34. In addition, the blender means 66 substantially eliminates "dead spots" within the hopper 12. Irrespective of position within the hopper 12, the materials flow downwardly towards the sump 30 for active mixing with the mixing chamber 46.

The passive mixing provided by the blender means 66 results in an energy savings. With the blender means 66, the desired degree of homogenity is achieved with less active mixing by the auger 36 and thus less power consumption. A further cost savings is derived from the housing 38. The load on the auger 36 is limited by the housing 38 to the weight of materials contained within the mixing chamber 46, such that the size of the motor 42 can be reduced (when compared with an open auger) and substantially matched to the load.

The housing 38 and baffle 40 also isolate the auger 36, the only moving and potentially dangerous feature of the apparatus 10. This isolation substantially minimizes the possibility of injury due to contact with the auger 36, e.g., during service or maintenance of the apparatus 10.

Referring again to FIG. 1, the apparatus 10 further includes roof means, generally designated 68, for substantially covering the auger 36, housing 38 and at least a portion of the drive belt 44. As shown, the roof means 68 includes a substantially V-shaped member 70 secured to and above the hopper 12.

One function of the roof means 68 is to substantially avoid loading of the materials directly onto the interconnection of the auger 36 and belt 44. Such loading would cause the accumulation of debris thereon and possible disengagement of the auger 36 and belt 44.

More significantly, the roof means 68 directs the materials towards the blender means 66 during loading of the hopper 12. That is, loading directly into the housing 38 is substantially avoided. As such, the materials pass into and through the blender means 66 prior to entering the mixing chamber 46, whereby at least partial pre-mixing or blending is achieved.

A single preferred embodiment of the present invention has been described herein. It is to be understood, however, that changes and modifications can be made without departing from the true scope and spirit of the present invention. This true scope and spirit are defined by the following claims, to be interpreterd in light of the foregoing specification.

What is claimed is:

1. An apparatus for mixing at least a first and second material to provide a mixture thereof comprising, in combination:

at least one hopper having an upper loading port, a lower discharge port, an inclined sidewall converging towards said discharge port, and a central region therein, said first and second materials being loaded into said hopper through said upper loading port and discharged from said hopper through said lower discharge port;

frame means for supporting said hopper in a substantially upright position;

an auger drivably mounted in said central region of said hopper, said auger being substantially vertical and extending substantially through said hopper;

a housing substantially enclosing said auger, said housing having an upper opening and a lower opening and defining a mixing chamber about said auger, said auger drawing said first and second materials into said mixing chamber through said lower opening, rotatably mixing said first and second materials therein, and discharging said first and second materials from said mixing chamber into said hopper through said upper opening;

a baffle secured to said housing, said baffle divergingly extending towards said lower discharge port of said hopper;

drive means for controllably driving said auger;

gate means for controllably closing said lower discharge port; and roof means for substantially directing said first and second materials towards said baffle during loading of said hopper;

said inclined sidewall of said hopper, said baffle attached to said housing and said roof means cooperatively defining blender means for pre-mixing said first and second materials prior to mixing thereof in said mixing chamber and for providing a blending flow pattern as said first and second materials flow through said hopper.

2. An apparatus as claimed in claim 1 wherein said inclined sidewall includes at least three substantially planar sidewall portions.

3. An apparatus as claimed in claim 1 wherein said baffle includes at least three substantially planar baffle portions corresponding to said substantially planar sidewall portions, respectively.

4. An apparatus as claimed in claim 1 wherein said frame means includes conveyor means for transporting said mixture, said conveyor means extending substantially below said lower discharge port for receipt of said mixture therethrough.

5. An apparatus as claimed in claim 1 wherein said frame means includes scale means for weighing said first and second materials in said hopper, whereby the composition of said mixture is controlled.

6. An apparatus as claimed in claim 1 wherein said roof means substantially covers said auger, said housing and at least a portion of said drive means so as to direct said first and second materials towards said blender means during loading of said hopper.

7. An apparatus as claimed in claim 1 wherein said hopper includes a sump above said lower discharge port.

8. An apparatus as claimed in claim 7 wherein said auger extends into said sump.

9. An apparatus as claimed in claim 8 wherein said lower opening of said housing is substantially above said lower discharge port so as to expose at least a portion of said auger within said sump.

* * * * *